United States Patent [19]

McGowan

[11] Patent Number: 4,510,018

[45] Date of Patent: Apr. 9, 1985

[54] SOLUTION AND PROCESS FOR TREATING COPPER AND COPPER ALLOYS

[75] Inventor: William M. McGowan, Dracut, Mass.

[73] Assignee: The Lea Manufacturing Company, Waterbury, Conn.

[21] Appl. No.: 581,812

[22] Filed: Feb. 21, 1984

[51] Int. Cl.[3] ..... C23F 1/00

[52] U.S. Cl. ..... 156/666; 134/3; 156/903; 252/79.2; 252/79.4; 252/142

[58] Field of Search ..... 134/3, 41; 156/666, 156/903; 252/79.2, 79.3, 79.4, 100, 142

[56] References Cited

U.S. PATENT DOCUMENTS

| | | | |
|---|---|---|---|
| 2,211,400 | 8/1940 | Wood | 252/100 |
| 3,537,926 | 11/1970 | Fischer | 156/903 X |
| 3,756,957 | 9/1973 | Shiga | 252/79.4 |
| 3,974,086 | 8/1976 | Rauhut et al. | 252/186 X |
| 4,141,850 | 2/1979 | Readio et al. | 252/79.4 |
| 4,144,119 | 3/1979 | Dutkewych et al. | 156/659.1 |
| 4,158,952 | 6/1979 | Oliver et al. | 70/52 |
| 4,378,270 | 3/1983 | Brasch | 156/659.1 |
| 4,459,216 | 7/1984 | Nakazato | 156/666 X |

*Primary Examiner*—William A. Powell

*Attorney, Agent, or Firm*—Robert L. Goldberg

[57] ABSTRACT

A solution and process for cleaning, deoxidizing and brightening copper or copper alloys comprising immersion of the copper or copper alloy in a solution comprising an aqueous mixture of sulfuric aid and peroxide, a low molecular weight ammonium compound, and a fatty acid amine. The solution may also be used as an etchant and/or to prepare copper or copper alloy for electroplating by modifying the concentrations of the solution's constituents.

24 Claims, No Drawings

SOLUTION AND PROCESS FOR TREATING COPPER AND COPPER ALLOYS

BACKGROUND OF THE INVENTION

1. Introduction

The present invention relates to a solution for treating copper and copper alloy. More specifically, this invention relates to a cleaning, deoxidizing and brightening solution for copper and copper alloys comprising sulfuric acid activated with hydrogen peroxide, low molecular weight ammonium compound and fatty acid amine. Aside from providing exceptional brightness, the solution of the present invention imparts considerable tarnish resistance to the copper or copper alloy surface treated.

2. Description of the Prior Art

The conventional methods employed for treating the surface of copper or copper alloys have included both mechanical and chemical techniques. Mechanical methods such as buff-polishing and barrel-polishing have a disadvantage of requiring a number of steps and a fair degree of experience. Furthermore, using such methods, it is difficult to obtain a uniform, lustered surface, and in many cases, depending on the size or form of the articles to be treated, polishing is difficult or even impossible.

Chemical methods, such as those wherein a mixture of acids, composed of for example, sulfuric, nitric, and a small amount of hydrochloric acid, is employed, has similarly not been entirely satisfactory. Not only is experience required in carrying out the operation, using such a mixture, but the operation itself is hazardous due to evolution of poisonous nitrous oxide fumes during the process of polishing. This is considered to be a serious drawback of this conventional method. In addition, when this method is employed, pitting, irregularity of color, change of color after polishing and the like are likely to occur. At the same time the method requires the use of concentrated nitric and sulfuric acids, the danger accompanying such use is apparent.

Other chemical methods involve the use of chromic acid in addition to the above-described acids. A major disadvantage of a solution of this type is that chromic acid is highly toxic requiring meticilous waste treatment which further adds to the cost of the cleaning, deoxidizing and brightening operation.

Other conventional methods employ the use of hydrogen peroxide with an acid or acids. Such methods are greatly restricted in regard to the temperature, concentration of the hydrogen peroxide and the concentration of acids to be employed in order to obtain the desired result. Furthermore, a major disadvantage of this method is that the stability of the hydrogen peroxide markedly deteriorates after copper is disolved to some extent during the cleaning, deoxidizing and brightening operations. The useful life of the solution is therefore remarkably short. It is believed that the reason is that heavy metal ions interfere and affect the stability of hydrogen peroxide. Because of these disadvantages, a pratical method for chemically treating the surface of copper and copper alloys with hydrogen peroxide has not been available. Although various stabilizing agents have been added to hydrogen peroxide type solutions, the above-described disadvantages in combining various types of acids still exists.

SUMMARY OF THE INVENTION

In accordance with the present invention there is provided a solution for treating copper and copper alloy surfaces. The treating solution comprises an aqueous mixture of peroxide and sulfuric acid, a low molecular weight ammonium compound and/or a fatty acid amine. The process for treating the copper and copper alloy surface may, depending on the desired result, be as simple as immersing the metal in the solution, or may comrise the steps of etching and rinsing prior to the immersion of the metal in the solution followed thereafter by a desmutting and final rinsing.

The solution of the present invention provides a unique process for producing either a matte or a super-bright finish on copper and copper alloys without the use of the traditional nitric/sulfuric acid mix which emits toxic nitrous oxide fumes, nor the chromate containing bright dips which present waste treatment problems. Moreover, it has been found that treatment with the present solution imparts considerable tarnish resistance to copper and copper alloys.

The solution of the present invention can be used as a bright dip solution, as an etchant or to prepare the copper or copper alloy for electroplating. The concentration of the several constituents of the solution will vary according to the particular treatment involved.

DESCRIPTION OF THE PREFERRED EMBODIMENTS

Though acids other than sulfuric acid may be used as a source of acidity for the bright dip solution of the present invention, sulfuric acid is preferred because it is the most economical, provides best results, avoids evolution of poisonous fumes generated by other acids such as nitric acid and yields copper sulfate upon saturation which is readily recovered by lowering the temperature of the residual solution. Other acids may be used in admixture with sulfuric acid for specific results. Hence, the term sulfuric acid as used herein means sulfuric acid alone or mixed with other acids in lesser amounts where desired.

When used as a bright dip solution, the concentration of the acid may vary within broad limits but preferably, the acid content of the solution is present in a concentration of at least 0.13 moles per liter and may vary between 0.05 and 0.6 moles per liter.

The peroxide content of the bright dip solution may also vary within broad limits such as from 2.5 to 15 moles per liter of solution. However, because peroxide is a relatively dangerous material to handle, its concentration is preferably maintained at relatively low concentration and preferably in the range between about 3 and 4 moles per liter. As the peroxide content drops below 3 moles per liter, however, the cleaning, deoxidizing, and brightening capabilities of the solution tend to decrease. Hence, the peroxide should be present in a concentration of at least 2.8 moles per liter. The preferred peroxide is hydrogen peroxide. Other peroxides may be used in admixture with the hydrogen peroxide for specific results. Therefore, the term peroxide as used herein means hydrogen peroxide alone or with other peroxides in lesser amounts where desired. Examples of suitable ammonium compounds include ammonium sulfate and ammonium acetate. However, other low molecular weight ammonium compounds such as ammonium fluoride and ammonium oxalate may be used. Use of ammonium hydroxide should be avoided so as not to interfere with the function of the acidic components of the solution. The concentration of the low molecular weight ammonium compound can vary within broad limits. The ammonium compound should be present in a concentration of at least 0.0378 moles per liter. However, the concentration may vary between 0.015 and 0.454 moles per liter and may even be present in higher concentrations as long as the ammonium compound remains in solution.

The fatty acid amine content of the solution may also vary within relatively broad limits such as from between 0.01 and 0.25 moles per liter. However, it should be present in a concentration of at least 0.01 moles per liter to achieve the desired result. The upper limit of the range is primarily governed by the ability to keep the fatty acid amine in solution as well as to prevent deleterious effects such as foaming.

It is believed that the fatty acid amine accelerates the polishing effect of the solution. In addition, the fatty acid amine constituent imparts enhanced tarnish resistance to the copper and copper alloy by leaving a thin hydrophobic film on the surface.

The fatty acid amine is a reaction product of fatty acids such as lauric acid, coconut fatty acid or linseed fatty acid and low molecular weight hydroxy amines such as monoisopropanolamine or aminoethylethanolamine. The reaction is extremely exothermic and is simply carried out by melting the fatty acid and adding the low molecular weight hydroxy amine to the melt in a ratio of about two parts fatty acid to about one part hydroxy amine. Other fatty acid amines may be used in conjunction with the above-mentioned fatty acid amines for specific results. Therefore, the term fatty acid amine as used herein means the reaction product of hydroxy amines such as monoisopropanolamine or aminoethylethanolamine and the above-mentioned fatty acid amines, either alone, together, or mixed with other fatty acid amines in lesser amounts where desired.

If desired, the solution may include additional surfactants based on alkylaryl polyether alcohols, sulfonates and sulfates. The presence of these surfactants, used primarily as a manufacturing aid, served to remove any surface oil present or formed on the surface of the copper or copper alloy during treatment. Hence, these additional surfactants should be present in an amount sufficient to remove any surface oil present thereon where desired.

Still yet another additive that may be added to the solution is a mixture of alcohol and ethylene glycol monobutyl ether. This admixture, when present in sufficient amounts, serves to keep the fatty acid amine in solution.

In another embodiment of the present invention there is provided a bright dip process for cleaning, deoxidizing and brightening copper and copper alloy surfaces. In its simplest form, the copper or copper alloy is immersed in the solution described herein-above for a time sufficient to clean, dexodize and brighten the copper or copper alloy. However, it is desirable to elevate the temperature of the the solution to at least 90°-110° F. prior to immersing the copper or copper alloy in the solution, particularly where the treating solution has been freshly prepared, since, it has been found, that old solutions need only be maintained at room temperature to achieve the desired result. In addition to preheating the treating solution, it may also be desirable to etch and/or rinse the copper or copper alloy surface prior to immersing the same in the solution. It may also be desirable to include the additional steps of rinsing, desmutting with a 5-10% by volume sulfuric acid solution and a final rinsing after the copper or copper alloy has been immersed in the treating solution.

As mentioned above, the solution of the present invention can also be used as an etchant. The constituents of the solution are adjusted to concentrations sufficient to provide a sustained rate of etching. Preferably, the sulfuric acid concentration is incresed by a factor of 7 while the remaining constituents are decreased by a factor of 7. However, the sulfuric acid concentration may be increased by as much as a factor 20.

The solution has also been found to be useful in preparing copper and copper alloy surfaces for electroplating. Again, the concentrations of the solution are adjusted to achieve the desired result. The sulfuric acid concentrations may vary within broad limits but preferably, the acid content of the solution is present in a concentration of at least 0.13 moles per liter and may vary between 0.05 and 12 moles per liter. The remaining concentration of constituents may range between those specified for the bright dip solution or may be decreased by a factor of 7 depending on the concentration of sulfuric acid. Treatment with the solution of present invention provides a smoother and cleaner surface which is essential in electroplating processes. Surprisingly, it has been found that the treatment with the present solution in preparation for electroplating provides excellent results despite the presence of the above-mentioned hydrophobic film present on the surface of the copper or copper alloy after treatment. It is believed that the superior plating is due to the highly uniform surface achieved as a result of treatment with the solution of the present invention.

The following examples are given to illustrate embodiments of the invention as it is presently preferred to practice it when the solution is used as a bright dip. It will be understood that these examples are illustrative, and the invention is not to be considered as restricted thereto except as indicated in the appended claims.

EXAMPLE 1

A treating solution is prepared to contain 0.13 moles per liter of sulfuric acid, 3.6 moles per liter of hydrogen peroxide, 0.75 moles per liter of ammonium compound, 0.01 moles per liter of a fatty acid amine.

EXAMPLE 2

Copper or copper alloy may be treated in accordance with the the following process steps:

1. Etching in a #525 etch (Lea Manufacturing Company) for 1 to 10 minutes;
2. Rinsing:
3. Immersing the copper or copper alloy in the treating solution prepared in accordance with example 1 for one to four minutes for maximum brightness, although the time may be extended up to fifteen minutes for maximum leveling;
4. Rinsing;
5. Desmutting with a 5-10% by volume sulfuric acid solution until the brown film formed on the copper or copper alloy is dissolved (usually one minute is adequate);
6. Final rinsing.

All processing tanks and rinses may be made from polypropylene, polyethylene, or PVC. Heating coils for the bright dip solution of the present invention may be made from stainless steel or teflon; electric heaters of quartz or teflon are also satisfactory. Temperature control is important for consistent results and economical operation so cooling coils of stainless steel for the bright dip are also recommended. A fume scrubber is not required as with the acid bright dips, but general exhausting is recommended.

Single rinses are adequate for manually operated lines, but double counterflow rinses are best for high production or automatic installations.

What is claimed is:

1. A solution for treating copper and copper alloy comprising an aqueous mixture of peroxide and sulfuric acid and a fatty acid amine.

2. A solution for treating copper and copper alloy comprising an aqueous mixture of peroxide and sulfuric acid, a low molecular weight ammonium compound and a fatty acid amine.

3. The solution of claims 1 or 2, wherein said peroxide is hydrogen peroxide present in a concentration of at least 3 moles per liter.

4. The solution of claim 3, wherein said peroxide concentration varies between about 3 to about 5 moles per liter.

5. The solution of claims 1 or 2, wherein said sulfuric acid is present in a concentration of at least 0.13 moles.

6. The solution of claim 5, wherein said sulfuric acid concentration varies between about 0.05 to about 0.6 moles per liter.

7. The solution of claim 2, wherein said ammonium compound is present in a concentration of at least 0.075 moles per liter.

8. The solution of claim 7, wherein said ammonium compound concentration varies between about 0.015 to about 0.454 moles per liter.

9. The solution of claim 8, wherein said ammonium compound is selected from the group of ammonium acetate, ammonium sulfate, ammonium fluoride and ammonium oxalate.

10. The solution of claims 1 or 2, wherein said fatty acid amine is present in a concentration of at least 0.01 moles per liter.

11. The solution of claim 9, wherein said fatty acid amine concentration varies between about 0.01 to about 0.25 moles per liter.

12. The solution of claim 10, wherein said fatty acid amine is the reaction product of a fatty acid selected from the group of lauric acid, coconut fatty acid and linseed fatty acid and a hydroxyamine selected from the group of monoisopropanolamine and amineothylethanolamine.

13. The solution of claims 1 or 2, including adding to said solution surfactants based on alkylaryl polyether alcohols, sulfonates and sulfates in an amount sufficient to remove any surface oil present or formed on said copper or copper alloy during treatment.

14. The solution of claims 1 or 2, including adding to said solution alcohol and ethylene glycol monobutyl ether in amounts sufficient to keep said fatty acid amine in said solution.

15. A process for cleaning and polishing copper or copper alloy with a solution prepared in accordance with claims 1 or 2, which process comprises immersing said copper or copper alloy in said solution for a time sufficient to clean, deoxidize and brighten said copper or copper alloy.

16. The process of claim 15, including the additional step of preheating said solution to a temperature of at least about 90°-100° F. prior to immersing said copper or copper alloy in said solution.

17. The process of claim 15, including the additional step of etching and thereafter rinsing said copper or copper alloy prior to immersing said copper or copper alloy in said solution.

18. The process of claim 15, including the additional step of rinsing, desmutting and rinsing said copper or copper alloy after immersing said copper or copper alloy in said solution.

19. The process of claim 18, wherein said desmutting comprises immersing said copper or copper alloy in a 5-10% by volume sulfuric acid solution.

20. A process for cleaning and polishing copper or copper alloy with a solution prepared in accordance with claims 1 or 2, which process comprises the steps of:

(a) etching said copper or copper alloy;
(b) rinsing
(c) immersing said etched and rinsed copper or copper alloy in said solution
(d) rinsing
(e) desmutting said copper or copper alloy with a 5-10% by volume sulfuric acid solution; and
(f) rinsing.

21. A process for etching copper or copper alloy with a solution prepared in accordance with claims 1 or 2, which process comprises contacting said copper or copper alloy with said solution, the constituents of said solution being present in concentrations sufficient to provide a sustained rate of etching of said copper or copper alloy.

22. The process of claim 21, wherein said peroxide is hydrogen peroxide present in a concentration between about 0.4 to 0.7 moles per liter, said sulfuric acid is present in a concentration between about 0.35 and 12 moles per liter, said fatty acid amine is present in a concentration between about 0.007 and 0.036 moles per liter and said ammonium compound is present in a concentration between about 0.002 and 0.065 moles per liter.

23. The process for preparing copper or copper alloy for electroplating with a solution prepared in accordance with claims 1 or 2, which process comprises contacting said copper or copper alloy with said solution, said constituents of said solution being present in concentrations sufficient to substantially completely remove from the surface of said copper or copper alloy any foreign material that interferes with the electroplating process.

24. The process of claim 23, wherein said peroxide is hydrogen peroxide present in a concentration between about 0.4 and 5 moles per liter, said sulfuric acid is present in a concentration between about 0.05 and 12 moles per liter, said fatty acid amine is present in a concentration between about 0.007 and 0.25 moles per liter and said ammonium compound is present in a concentration between about 0.002 and 0.454 moles per liter.

* * * * *